US005309718A

United States Patent [19]

Loving

[11] Patent Number: 5,309,718

[45] Date of Patent: May 10, 1994

[54] LIQUID FUEL TURBOCHARGED POWER PLANT AND METHOD

[75] Inventor: Ronald E. Loving, Simi Valley, Calif.

[73] Assignee: Hughes Aircraft Company, Los Angeles, Calif.

[21] Appl. No.: 944,558

[22] Filed: Sep. 14, 1992

[51] Int. Cl.[5] ..... F02C 1/00

[52] U.S. Cl. ..... 60/722; 60/737; 60/749; 431/353

[58] Field of Search ..... 60/39.827, 39.828, 722, 60/737, 739, 753, 749; 431/11, 245, 246, 350, 353

[56] References Cited

U.S. PATENT DOCUMENTS

| | | | |
|---|---|---|---|
| 2,577,918 | 12/1951 | Rowe | 60/749 |
| 2,626,655 | 1/1953 | Trautman et al. | 60/39.141 |
| 2,641,904 | 6/1953 | Bouffart | 60/722 |
| 2,692,479 | 10/1954 | Lloyd | 60/748 |
| 2,698,050 | 12/1954 | Bloomer et al. | 60/753 |
| 2,706,150 | 4/1955 | Lloyd | 60/39.12 |
| 3,012,402 | 12/1961 | Probert et al. | 60/722 |
| 3,434,012 | 3/1969 | Rademacher | 60/39.828 |
| 4,077,761 | 3/1978 | Dollinger et al. | 431/353 |
| 4,790,744 | 12/1988 | Bellet et al. | 60/749 |
| 5,054,280 | 10/1991 | Ishibashi et al. | 60/749 |
| 5,095,696 | 3/1992 | Gulati et al. | 60/749 |

*Primary Examiner*—Richard A. Bertsch
*Assistant Examiner*—Michael I. Kocharov
*Attorney, Agent, or Firm*—W. K. Denson-Low

[57] ABSTRACT

A liquid fuel power plant (100) including an open-ended combustion chamber (102) and a first mechanism (110) for delivering a combustible liquid fuel to the combustion chamber (102). A second mechanism (118) is included for delivering compressed air to the combustion chamber (102) to provide a pressurized air-fuel mixture. A third mechanism (130) ignites the pressurized air-fuel mixture in the combustion chamber (102) and a fourth mechanism (134) is provided for extending the length of the combustion chamber (102) for decomposing the pressurized air-fuel mixture to provide an exhaust gas comprised of fundamental elements. Finally, a fifth mechanism (142) is provided for using the exhaust gas to perform useful work. The air inlet line (116) delivers compressed air from a turbocharger (118) which is preheated in an air passageway (128) and thereafter mixed with the fuel in the combustion chamber (102). The residue of the combustion is thereafter forced by the compressed air into a spiral-shaped extension (134) which forms a reaction region (138) of the combustion chamber (102). The reaction region (138) becomes sufficiently hot to ensure complete decomposition of the mixture.

9 Claims, 8 Drawing Sheets

LIQUID FUEL TURBOCHARGED POWER PLANT AND METHOD

BACKGROUND OF THE INVENTION

1. Field of the Invention

The present invention relates to power plants. More specifically, the present invention relates to methods and apparatus for a non-polluting turbo-charged power plant having a liquid fuel burning chamber for the combustion of hydrocarbon based fuels.

While the present invention is described herein with reference to illustrative embodiments for particular applications, it should be understood that the invention is not limited thereto. Those having ordinary skill in the art and access to the teachings provided herein will recognize additional modifications, applications and embodiments within the scope thereof and additional fields in which the present invention would be of significant utility.

2. Description of the Related Art

Many different types of liquid fueled power plants are known in the art for providing thrust to, for example, propel a projectile or drive a generator. Examples include liquid fueled jet engines, piston engines and rocket motors of various designs. Each of these liquid fueled power plant designs suffer from a number of problems during the launch and flight stages of the projectile or when driving the generator. The problems common to liquid fueled power plant designs include the generation of excessive amounts of noise and heat. Also, in the case of a liquid fueled rocket motor, large amounts of smoke can be generated which results in increased levels of atmospheric pollution.

Low detectability of a projectile during target approach is necessary in stealth operations. However, the generation of excessive noise during the launch and flight stages increases the probability that the projectile will be detected upon approach. Likewise, generation of large amounts of heat by the projectile can be detected by infrared sensors such as the forward looking infrared devices utilized by aircraft. The heat generated by the projectile can also be detected visually by utilizing night vision goggles. The smoke generated by certain liquid fueled rocket motors creates a visual smoke trail. Thus, the projectile is easier to track and the origin of the launch point is easier to determine. The density of the smoke trail is dependent upon the type of rocket motor fuel employed. Each of these problems increase the probability of projectile detection during approach to the target. Likewise, when driving a generator with, for example, a liquid fueled piston engine, the smoke exhaust from the engine increases the atmospheric pollution level.

The use of a turbocharger or supercharger in combination with a liquid fueled power plant is known. In particular, the use of a turbocharger in combination with a turbine jet engine, piston engine or turbine rocket motor capable of providing thrust to propel a projectile is also known. In general, the use of a turbocharger in combination with any of the above mentioned power plants affords control of the direction of the hot expanding exhaust gases of the power plant, increases the volume of the hot expanding exhaust gases, and provides oxidation of the liquid fuel under pressure.

A turbine jet engine has a long cylindrical body and includes one or more liquid fuel burning chambers. The burning chambers are located at the center of the long cylindrical body and normally burn at temperatures in excess of three-thousand degrees Fahrenheit. The turbine jet engine includes multiple compression stages comprising a turbine or turbocharger located in the forward section of the jet engine. The turbocharger produces a very high pressure in the burning chambers. When the liquid fuel is injected into the burning chamber, the fuel is combusted to provide hot, high pressure gases. A high percentage of the output gases are fed back and utilized in a control loop to drive the turbine wheel. The balance of the output gases are used to perform useful work such as driving an aircraft or missile.

The outer walls of the jet engine burning chamber are at a lower temperature than that of the flame at the center of the burner. Because of the temperature differential between the flame and the outer wall and the operating temperature of the burning chamber, the liquid fuel, which is generally a hydrocarbon based fuel, is not totally combusted. When particles of a hydrocarbon based fuel are not totally burned, hydrocarbon based pollutants are produced. Further, since the liquid fuel is not totally combusted, the turbine jet engine is not fuel efficient. Additionally, the turbine jet engine is very noisy, expensive to build and produces excessive heat. Each of these characteristics of turbine jet engines increases the detectability of a projectile and the pollution level of the atmosphere.

Liquid fueled piston engines employing turbochargers are used in air vehicles while liquid fueled piston engines utilizing turbochargers or superchargers are used in stationary drive applications. As an example, the turbine associated with a turbocharger is located external to the piston engine block in a position normally occupied by a carburetor. Hot exhaust gases and ambient air are each fed to the turbine which compresses the gas mixture. The compressed gas mixture enables a higher volume of air to be fed to the designated piston chamber. The compressed air (e.g., greater than one atmosphere) is mixed with liquid fuel and ignited to provide a greater force then otherwise available to the crankshaft of a piston engine. Use of a turbocharger in a liquid fueled turbine rocket motor (e.g., a turbine jet engine in a rocket) is also known. The turbocharger is employed to generate and feed high volume compressed air to one or more combustion chambers. The pressurized air forces a higher volume of air into the fixed volume combustion chamber. The higher pressure exhaust gas of the combustion chamber is used to drive the turbine wheel in a feedback control loop. Both the liquid fueled piston engine and the turbine rocket motor are very noisy. Therefore, a projectile propelled by either power plant can be tracked by an audible sensor. Further, depending upon the type of liquid fuel employed in the piston engine and the rocket motor, large amounts of smoke can be generated which results in increased levels of atmospheric pollution.

Another example of a liquid fuel power plant design of the prior art is an incinerator employed for destroying hazardous waste. The incinerator includes a cylindrical combustion chamber joined by a flat circular plate to a smaller inlet pipe. Fuel nozzles protrude through the flat plate into the combustion chamber. The incinerator includes a blower air input which can be comprised of an impeller blade type air compressor. The function of the blower air input is to provide an oxidizer to mix with the liquid fuel to promote combustion. The oxidizer can also be provided by a turbocharger, a supercharger or similar device.

The air and fuel are not premixed but instead are injected into the incinerator combustion chamber at the point of flame stabilization. The fuel is ignited and the combustion chamber is heated to operating temperature. The hazardous waste material to be combusted is then delivered to the combustion chamber by fuel injectors. Total combustion of the fuel is ensured by recirculation of the gas and air mixture. Thus, low nitrous oxide ($NO_x$) levels are produced. The heat generated by the combustion is released to the atmosphere through a long exhaust tube. The incinerator is intended only to destroy hazardous waste material and thus, is not a power plant capable of providing thrust to propel a projectile or otherwise performs useful work. Another device suitable for use with the incinerator for providing the oxidizer to mix with the liquid fuel is a motor driven radial outflow compressor. The radial outflow compressor is not driven by the exhaust gases of the combustion chamber. Normally, an alternative power source such as an electric motor or a piston or rotary engine is employed to drive the radial outflow compressor.

Thus, there is a need in the art for improvements in the design of liquid fueled power plants to reduce the detectability of and the exhausted pollutants from the power plants.

SUMMARY OF THE INVENTION

The need in the art is addressed by the liquid fuel power plant and method of the present invention. The invention includes an open-ended combustion chamber and a first mechanism for delivering a combustible liquid fuel to the combustion chamber. A second mechanism is included for delivering compressed air to the combustion chamber to provide a pressurized air-fuel mixture. A third mechanism ignites the pressurized air-fuel mixture in the combustion chamber and a fourth mechanism is provided for extending the length of the combustion chamber for decomposing the pressurized air-fuel mixture to provide an exhaust gas comprised of fundamental elements. Finally, a fifth mechanism is provided for using the exhaust gas to perform useful work.

In a preferred embodiment, the liquid fuel power plant includes separate air and fuel input lines. The air input line delivers compressed air from a turbocharger or a supercharger which is preheated in an air passageway and thereafter mixed with the fuel in the combustion chamber. An igniter causes combustion of a compressed air-fuel mixture in an ignition region of the combustion chamber. The residue of the combustion is thereafter forced by the compressed air into a spiral-shaped extension which forms a reaction region of the combustion chamber. The reaction region becomes sufficiently hot to ensure complete decomposition of the mixture. The hot pressurized exhaust gas, which is non-polluting, is directed by an exhaust tube to a load such as a turbine.

DESCRIPTION OF THE INVENTION

Figure 1:
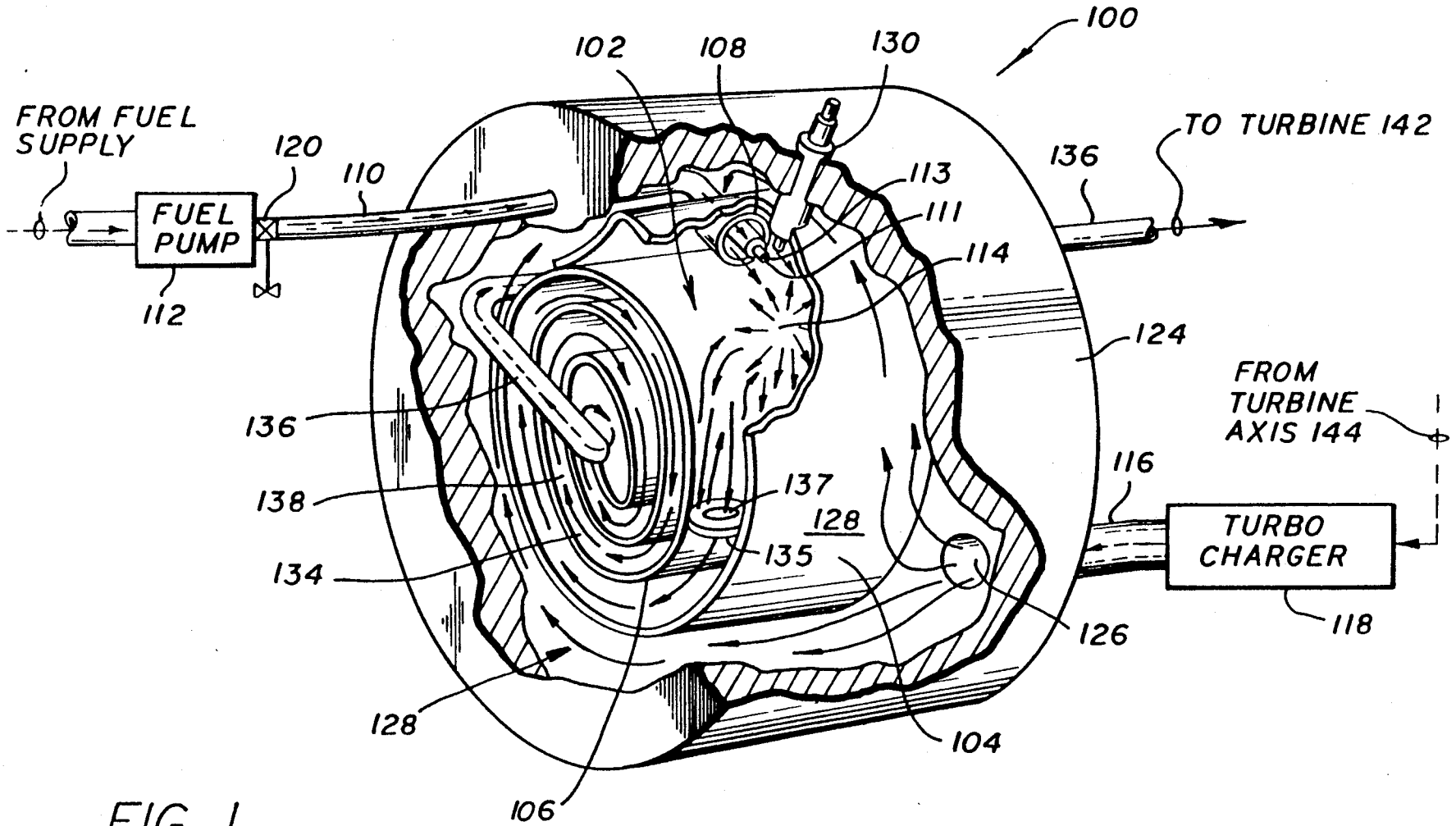
FIG. 1 is a perspective view, partly cutaway, of an illustrative embodiment of the liquid fuel power plant of the present invention showing a turbo charger and a combustion chamber extension having a spiral construction.

The invention is a liquid fuel power plant 100 as shown in FIG. 1. The power plant 100 includes an open-ended combustion chamber 102 which has no moving parts. The combustion chamber 102 preferably employed in the present invention is bounded by an outer wall 104 and an inner wall 106 as shown in the cutaway portion of FIG. 1. A port 108 formed in the outer wall 104 accommodates a fuel feed line 110 carrying a combustible hydrocarbon based fuel. The fuel is fed from a fuel source (not shown) through the fuel feed line 110 by conventional methods such as, for example, by a fuel pump 112 shown in FIG. 1. The fuel feed line 110 terminates in a fine spray nozzle 111 formed by punching a hole 113 in the end of the fuel feed line 110 for atomizing the fuel delivered to an ignition region 114.

The port 108 also serves as an inlet port for preheated compressed air. The compressed air is properly mixed with the particular combustible fuel in the ignition region 114 of the combustion chamber 102. The compressed air serves as an oxidizer to sustain the burning of the combustible fuel in the ignition region 114. In the preferred embodiment of the liquid fuel power plant 100 shown in FIG. 1, compressed air is provided to an air inlet line 116 by a turbocharger 118. The turbocharger 118 is one of a variety known in the art and is operated by a rotating shaft such as the axis of a turbine as described hereinbelow. The fuel feed line 110 can include a gate control valve 120 to prevent the air-fuel mixture from backfeeding into line 110. The input air pressure delivered to the combustion chamber 102 via the air inlet line 116 is greater than the output pressure exiting the combustion chamber 102 because the turbocharger 118 compresses the input air. Upon ignition of the air-fuel mixture, the heat of combustion provides expansion of the output gases to perform useful work. Therefore, a gate control valve in not required to be positioned within the air inlet line 116.

Completely surrounding the combustion chamber 102 is a heat shield 124 which serves to prevent the loss of heat generated by the combustion within the chamber 102. The compressed air inlet line 116 penetrates one end of the heat shield 124 at an opening 126 as shown in FIG. 1. Located between the heat shield 124 and the outer wall 104 of the combustion chamber 102 is an air passageway 128. The air passageway 128 serves to direct the compressed input air from the turbocharger 118 to the port 108. The compressed input air passing through the air passageway 128 is preheated by the heat transmitted through the outer wall 104 of the combustion chamber 102. Preheating the compressed input air within the air passageway 128 in this manner increases the efficiency of combustion within the chamber 102.

Passing through the heat shield 124 and the inner wall 104 of the combustion chamber 102 is an igniter 130 as shown in FIG. 1. The igniter 130 extends into the combustion chamber 102 and functions to ignite the pressurized air-fuel mixture within the ignition region 114 therein. The igniter 130 can be one of several devices depending upon the hydrocarbon based fuel utilized in the power plant 100. For example, if a lightweight fuel such as natural gas, butane, propane or gasoline is employed, the igniter 130 can be a spark plug. For lightweight fuels, the spark plug is continuously energized. If a heavier fuel such as diesel is utilized, a spark plug continues to be the preferred igniter device. However, a glow wire can also be employed as the igniter device. A glow plug incorporates a platinum wire that is constantly energized and glows white hot to ensure burning of the air-fuel mixture. The igniter 130 is connected to an electrical circuit (not shown) to provide a spark for burning the air-fuel mixture.

Figure 2:
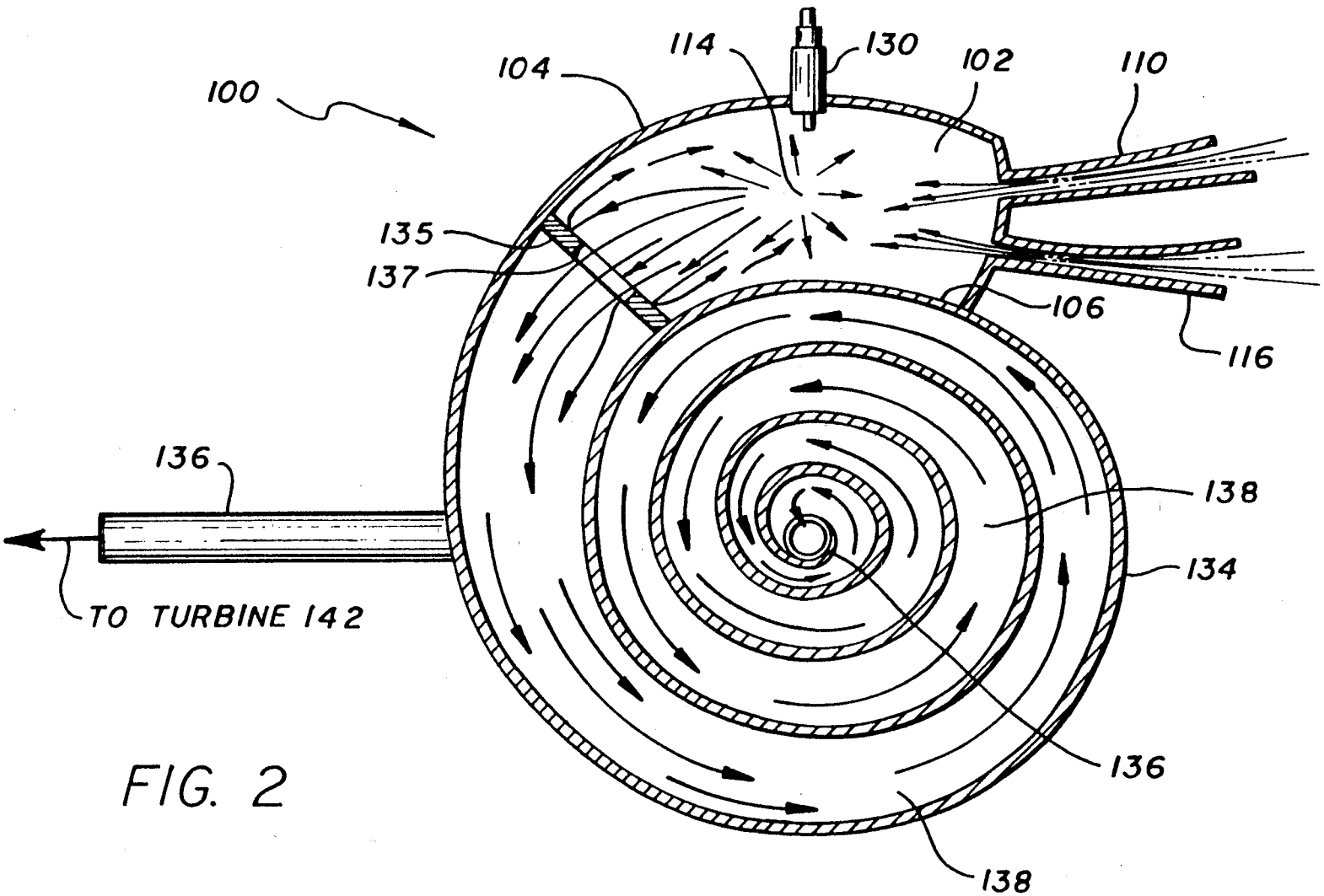
FIG. 2 is a simplified representative view of the liquid fuel power plant of FIG. 1 showing additional detail of the spiral construction of the combustion chamber extension.

The combustion chamber 102 further includes an extension 134. Many different configurations of the combustion chamber extension 134 are suitable for use in the present invention. However, as shown in FIGS. 1 and 2, the combustion chamber extension 134 disclosed in the exemplary embodiment is spiral-shaped and tapered and is formed by the inner wall 106 being wrapped inward on itself. The end of the extension 134 is located at the center of the spiral and is connected in a manner known in the art to an exhaust tube 136 as shown in FIGS. 1 and 2. The atomized combustible fuel and compressed input air are mixed and ignited in the ignition region 114 of the combustion chamber 102. The small fuel droplets caused by atomizing the combustible fuel in the spray nozzle 111 results in higher efficiency ignition of cheaper fuels that are otherwise difficult to burn. A by-product of the combustion within the ignition region 114 of chamber 102 is hot pressurized gases which include pollutants. The presence of the gate control valve 120 and the pressurized air provided by the turbocharger 118 prevent the hot pressurized gases from entering the fuel feed line 110 and the compressed air inlet line 116, respectively.

The hot pressurized gases are forced to travel down into the spiral-shaped extension 134 by the expansion of the compressed air and the ignition of the air-fuel mixture. Located within the spiral-shaped extension 134 is an air-flow turbulator 135 as shown in FIGS. 1 and 2. The turbulator 135 exhibits a construction similar to a washer or disk having a center penetration 137 therethrough. The turbulator 135 is positioned across the width of the spiral-shaped extension 134 and serves to generate turbulence in the hot pressurized gases. The flow of the hot pressurized gases from the ignition region 114 of the chamber 102 is interrupted by the turbulator 135. That portion of the hot pressurized gases not passing through the center penetration 137 of the turbulator 135 is temporarily delayed from exiting the ignition region 114. The delayed gases are forced to recirculate back to the ignition region 114. Additional exposure of the hot pressurized gases to the ignition region 114 ensures complete combustion of the air-fuel mixture. The distance between the ignition region 114 and the turbulator 135 is minimized to approximate a straight line as is best illustrated in FIG. 2. Minimizing this distance increases the probability that the hot pressurized gases will be completely combusted.

The heat created by the combustion within the chamber 102 saturates the inner wall 106 thus raising the temperature of the extension 134 to that of the chamber 102. The spiral-shaped extension 134 effectively lengthens the combustion chamber 102 from (6"-8") to (3' to 5'). The length of the spiral-shaped extension 134 is dependent upon the diameter of the combustion chamber 102 and the type of fuel utilized. By lengthening the chamber 102 and by reusing the heat generated by the combustion, total burning of the air-fuel mixture and any hydrocarbon pollutants created in the chamber 102 is ensured. Lengthening the combustion chamber 102 via the extension 134 also prevents ignition termination (e.g., flame out) since the combustion can take place anywhere along the length of the extension 134.

The spiral-shaped extension 134 forms a reaction region 138 which is connected to the exhaust tube 136 as shown in FIG. 2. The hydrocarbon pollutants created in the ignition region 114 are either burned and disintegrated or are forced to decompose to the base elements in the reaction region 138 due to the presence of the heat. Thus, the reaction region 138 of the extension 134 expels pollution free gases to the exhaust tube 136 as shown in FIGS. 1 and 2. The pollution free gases are thereafter directed to a mechanism for driving a load as described hereinbelow. Further, the reaction region 138 of the extension 134 enables the use of a very lean air-fuel mixture which improves the efficiency of operation.

The combustion chamber 102 and the associated extension 134 is formed of high temperature ceramic or metal and can withstand temperatures in excess of 3000 degrees Fahrenheit. The combustion chamber 102 and the extension 134 can be of unitary construction and thus is either completely ceramic or metal. An example of a suitable metal for use in forming the combustion chamber 102 and the extension 134 including the outer wall 104 and the inner wall 106 is a nickel steel based alloy. Likewise, the air-flow turbulator 135 and the exhaust tube 136 is either formed from ceramic or metal that is consistent with the material of the combustion chamber 102. In general, the nickel alloy construction is employed for lower temperature operations while the ceramic construction is utilized for higher temperature operations. Additionally, the heat shield 124 is comprised of any suitable material for preventing the flow of heat past the outer wall 104 of the combustion chamber 102. An example of a suitable material for the heat shield 124 is porous ceramic of the type having a bubble construction that insulates heat.

During operation, the liquid fuel power plant 100 functions in the following manner. The combustible fuel is forced through the fuel feed line 110 by the fuel pump 112 to the spray nozzle 111. Simultaneously, the turbocharger 118 delivers preheated compressed air to the port 108 via the air passageway 128. The compressed air and combustible fuel are mixed in the combustion chamber 102 as shown in FIGS. 1 and 2. The air-fuel mixture is ignited by the igniter 130 resulting in combustion in the ignition region 114 of the chamber 102. The air-fuel mixture is combusted and generates hot expanding gases. The pressure of the hot expanding gases is derived from the pressure of the compressed air and the expansion of the air when the fuel is combusted. The turbocharger 118 provides several advantages which include controlling the direction of and increasing the output volume of the hot expanding gases. Compressing the ambient air that is mixed with the hydrocarbon based fuel ensures that the input pressure to the combustion chamber 102 is greater than the output pressure. This condition ensures that the hot expanding gases will only be directed to the exhaust tube 136 and will not be fed back into the air inlet line 116. Further, compressing the ambient air permits forcing a higher volume of air into the fixed volume of the combustion chamber 102.

As the present combustion of the air-fuel mixture takes place in the combustion chamber 102, the gases from the immediate previous combustion will be forced down into the reaction region 138 of the spiral-shaped extension 134 by the pressure of the expanding gases. The flow of the hot pressurized gases from the ignition region 114 is partially interrupted by the turbulator 135. The portion of the hot pressurized gases not passing through the center penetration 137 are temporarily delayed from exiting the ignition region 114. The delayed gases are redirected to the ignition region 114 to ensure complete combustion of the air-fuel mixture. A portion of the expanding gases pass the turbulator 135 and travel down into the spiral-shaped extension 134. The inner wall 106, which forms the extension 134, retains sufficient heat from the hot gases to ensure complete combustion or decomposition of the fuel and any residual pollutants before reaching the exhaust tube 136. The exhaust gases are, therefore, pollution free and can be controlled to produce useful work such as providing shaft power output from the power plant 100.

The combustion chamber 102 of the liquid fuel power plant 100 is operated within the temperature range of from 400 degrees Fahrenheit to 2000 degrees Fahrenheit. The exhaust gases are therefore within the low-to-medium temperature range while the pressure of the exhaust gases is within the low-to-medium pressure range (e.g., up to 100 PSI). This temperature range has been selected to ensure complete combustion of the fuel while avoiding production of nitrous oxides ($NO_x$). Operating temperatures above 2000 degrees Fahrenheit result in the production of higher nitrous oxides ($NO_x$) levels. By operating the combustion chamber 102 in the selected temperature range, the fuel will be completely combusted or decomposed to basic pollution free elements such as carbon, hydrogen and oxygen. Therefore, the combustion chamber 102 functions as a catalytic converter in the selected temperature range.

Any inexpensive fuel can be used in the combustion chamber 102 including diesel, kerosene, JP fuels and natural gas. By atomizing the combustible fuel in the spray nozzle 111, cheaper fuels that are otherwise difficult to burn can be utilized. By varying the proportions of compressed air and fuel, the proper mixture can be determined to ensure total combustion of the fuel. Total combustion means that all the energy in the fuel has been utilized. Each individual fuel will require an adjustment of the proportion of the compressed air utilized. After the correct mixture of air and fuel is achieved, less fuel will be necessary to generate the energy to accomplish a task than was previously required for other known power plants using the same fuel.

The liquid fuel power plant 100 of the present invention is a small, lightweight, multi-fuel, non-polluting turbocharged combustion engine in which the low-to-medium temperature and pressure exhaust gases are employed to operate a load. The combustion chamber 102 has no moving parts and is a stand-alone device that utilizes inexpensive hydrocarbon based fuels. The power plant 100 is very versatile in that it can be used for developing hot pressurized gases for use in, for example, an electrical generator, a turbine water pump, a recreational vehicle, a garden tractor, a battery charger, a small aircraft or a projectile. More specifically, when utilized with a turbine wheel to rotate a drive shaft, the power plant 100 provides inexpensive pollution free power to propel unmanned air vehicles or to operate an electrical generator to provide AC or DC voltage and current.

Figure 3:
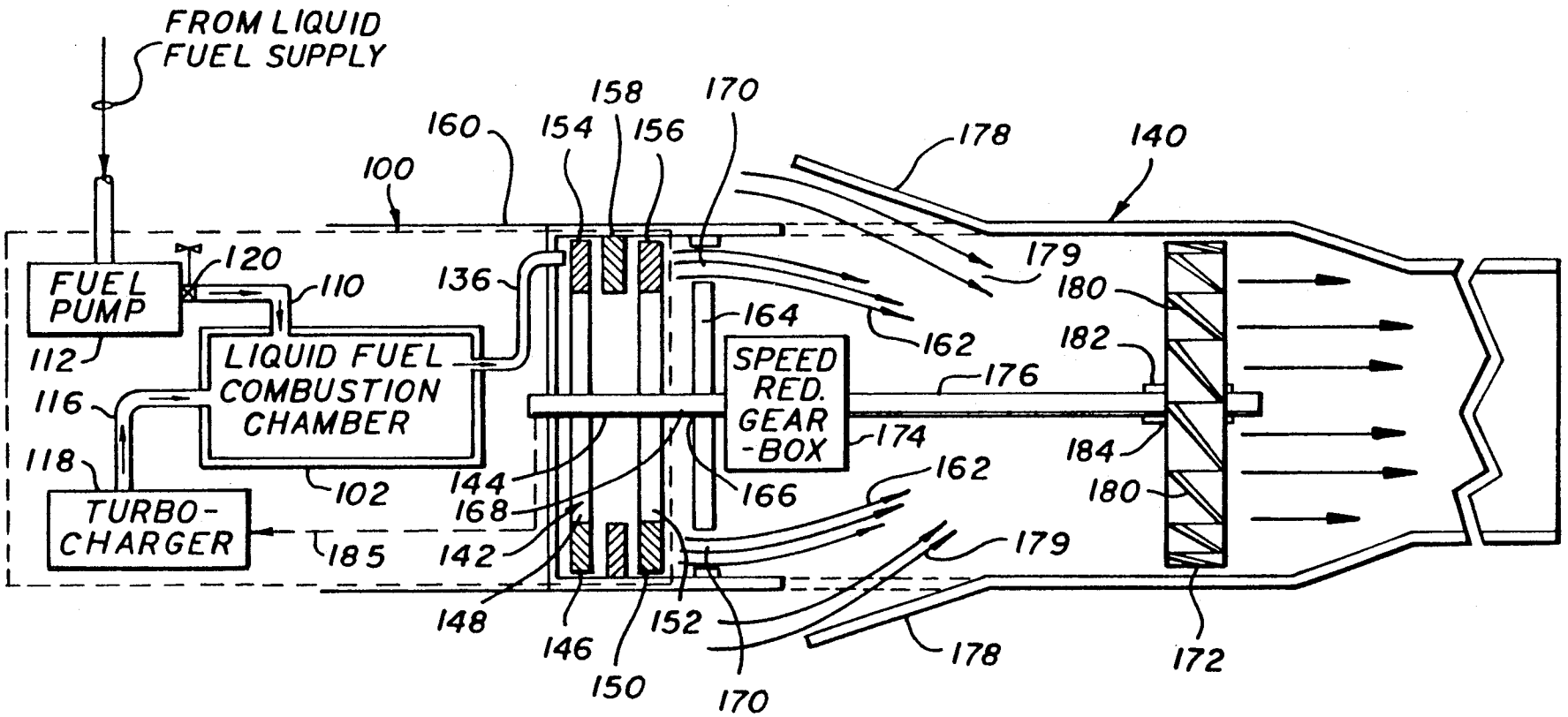
FIG. 3 is a simplified view, partly in section and partly in block, of an application of the liquid fuel power plant of FIG. 1 showing the power plant connected to a ducted fan load within a typical projectile tube.
Figure 4:
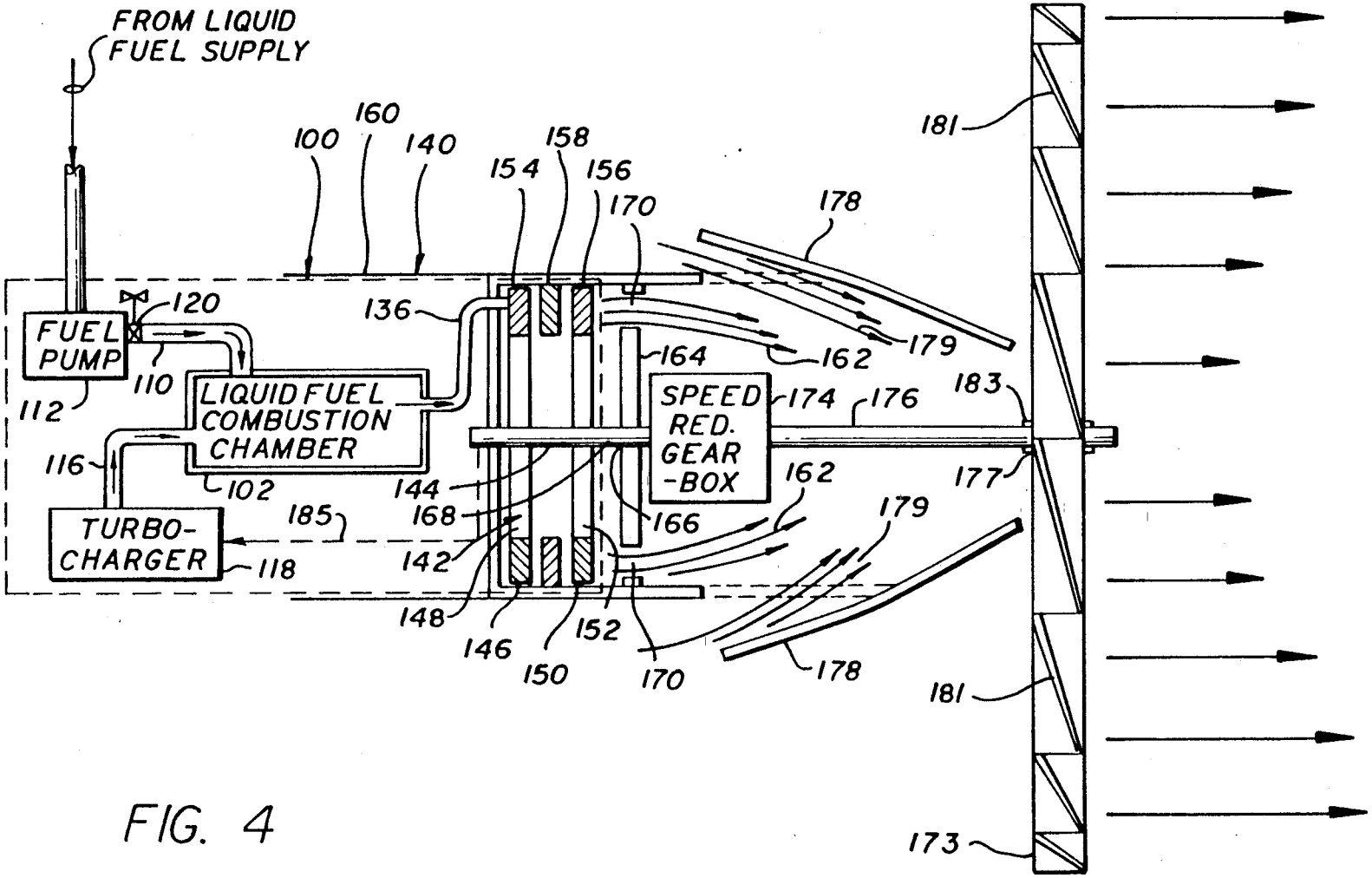
FIG. 4 is a simplified view, partly in section and partly in block, of an application of the liquid fuel power plant of FIG. 1 showing the power plant connected to an unducted fan load within a typical projectile tube.
Figure 5:
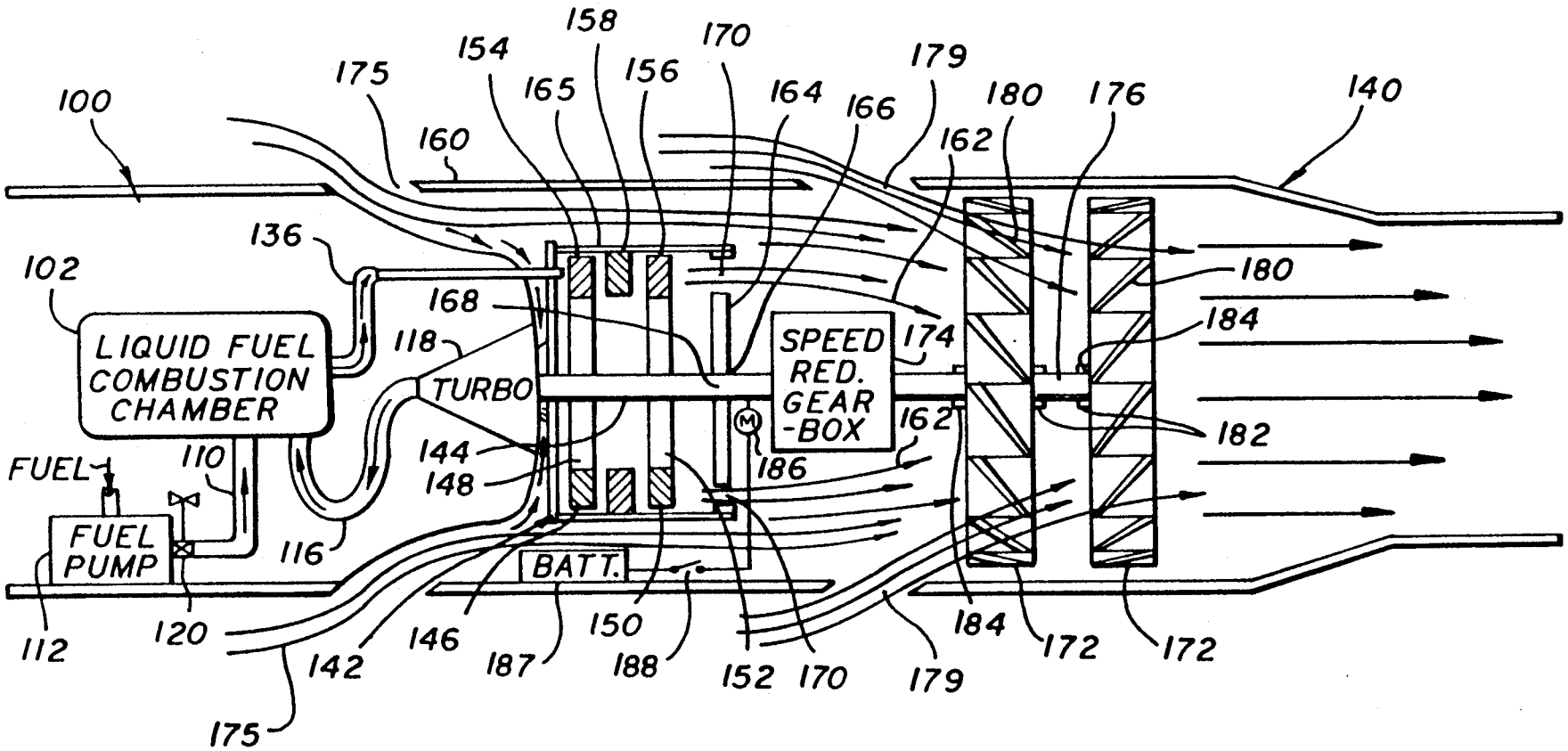
FIG. 5 is a more detailed view, partly in section and partly in block, of an application of the liquid fuel power plant of FIG. 1 showing the power plant connected to a pair of ducted fan loads within a typical projectile tube.

Several applications of the liquid fuel power plant 100 are shown in FIGS. 3–6. In FIGS. 3–5, the power plant 100 is shown located within a projectile 140 and is utilized to rotate a turbine 142 at high RPM. The exhaust tube 136 is connected between the end of the combustion chamber extension 134 (shown in FIGS. 1 and 2) and the turbine 142. The pressurized gases generated by the combustion chamber 102 are directed through the exhaust tube 136 to spin the turbine 142 about a turbine axis 144 as described hereinbelow. Note that it is also possible to connect the exhaust tube 136 of the combustion chamber 102 to a manifold (not shown) and then to connect a plurality of exhaust tubes from the manifold to the turbine 142. In either case, the pressurized gases are directed to the turbine 142 which is of a conventional design comprising one or more turbine blade wheels.

The turbine 142 of the power plant 100 shown in FIGS. 3–6 depicts a two stage turbine for illustration purposes only. It is to be understood that a single stage turbine or a multiple stage turbine (e.g., greater than one stage) can also be utilized. In general, multiple stage turbines impart greater efficiency and horsepower. It is further noted that the pressure range of the hot gases produced by the power plant 100 is also dependent upon the number of turbine stages and the number and shape of the blades per turbine stage. The turbine 142 includes a first turbine stage 146 having a first rotating wheel 148 and a second turbine stage 150 having a second rotating wheel 152. The end of the first rotating wheel 148 includes a first set of turbine blades 154 and the end of the second rotating wheel 152 includes a second set of turbine blades 156. Positioned between the first and second sets of turbine blades 154 and 156 is a stationary set of blades 158 commonly referred to as stators. Stators are utilized to condition or redirect the gases for the next turbine stage.

The pressurized gases generated by the combustion chamber 102 are directed to the first turbine stage 146 by the exhaust tube 136. Since the first and second sets of turbine blades 154 and 156 are respectively connected to the first and second rotating wheels 148 and 152, then each set of turbine blades 154 and 156 also rotate. The pressurized gases initially strike the first set of turbine blades 154 which causes the first rotating wheel 148 of the first turbine stage 146 to rotate about the axis 144. The gases are then redirected to the stationary set of blades 158. The stationary set of blades 158 are mounted to an outer tube or metal housing 160 of the projectile 140 as shown in FIGS. 3-5. In the example implementation, the shape of the stationary set of turbine blades 158 is opposed to that of the first and second sets of turbine blades 154 and 156. Thus, a function of the stationary set of blades 158 is to redirect and condition the gases from the output of the first rotating wheel 148 to the second turbine stage 150. The stationary set of blades 158 also orients the gases to the correct angle to achieve the maximum energy transfer to the second turbine stage 150.

The gases are then directed from the stationary set of blades 158 to the second set of turbine blades 156. When the gases strike the second set of turbine blades 156, the second rotating wheel 152 is caused to rotate about the axis 144. In general, the first turbine stage 146 is approximately 75% efficient while the second turbine stage 150 is approximately 10% efficient. A third turbine stage, if employed, would be approximately 5% efficient with the remainder of the energy in the pressurized gases being lost as heat energy. The density, temperature and pressure of the gases emitted from the exhaust tube 136 will determine the rotational speed in RPM of the turbine 142. As an example, a turbine wheel having a diameter of 5" and a drive shaft length of 4" and weighing approximately five pounds can be rated to provide a forty horsepower output.

The exhaust gases (indicated by numeral 162) expelled from the second turbine stage 150 will be at or near atmospheric pressure. This indicates that the first and second turbine stages 146 and 150 have absorbed almost all of the energy contained in the gases. Therefore, noise is not likely to be generated by the gases. This feature further minimizes the generation of noise in the entire power plant 100 making it more difficult to detect with audible detection devices. Thus, the power plant 100 is more attractive for use in stealth type devices.

The exhaust gases 162 are then directed from an exhaust region of the turbine 142 to a diffuser plate 164 as shown in FIGS. 3-6. In the example implementation of the present invention, the diffuser plate 164 is a metallic plate mounted to the inside surface of the outer tube 160 of the projectile 140 as shown in FIGS. 3 and 4. However, in FIGS. 5 and 6 in which more detail is shown, the diffuser plate 164 is integral with a turbine housing 165. The diffuser plate 164 includes a penetration 166 for the passage of a drive shaft 168. One of the functions of the diffuser plate 164 is to direct the exhaust gases out of the exhaust region of the turbine 142 through a passageway 170 to a load. Examples of appropriate loads include a ducted fan type propeller 172 positioned within the projectile 140 shown in FIGS. 3 and 5 and an unducted fan type propeller 173 located external to the projectile 140 shown in FIG. 4. A pair of the ducted fan type propellers 172 are shown stacked in tandem in FIG. 5 for increasing the pulling force on the exhaust gases and ambient air. Another function of the diffuser plate 164 is to absorb additional energy from the gases. This action causes the gases to slow down further minimizing the noise generated by the power plant 100.

The rotating drive shaft 168 can be connected to a speed reduction gearbox 174 to achieve the proper rotational speed for the load attached to the power plant 100. The load is attached to the power plant 100 via an output drive shaft 176 extending from the speed reduction gearbox 174 as shown in FIGS. 3-6. It is noted that the speed reduction gearbox 174 can be of a conventional design and is an optional feature that may not be necessary in a particular load application. A plurality of loads can be driven by the power plant 100. When the power plant 100 is utilized to propel the projectile 140, an appropriate load is the ducted fan type propeller 172 shown in FIGS. 3 and 5 or the unducted fan type propeller 173 shown in FIG. 4. Another load suitable for use with the power plant 100 is an electrical load discussed hereinbelow.

The metal housing or outer tube 160 of the projectile 140 includes a vent flap 178 shown in FIGS. 3-4. The function of the vent flap 178 is to admit ambient air (indicated by the numeral 179) into the projectile 140. The ambient air 179 is drawn into the projectile 140 by the ducted fan type propellers 172 shown in FIGS. 3 and 5 and by the unducted fan type propeller 173 shown in FIG. 4. The ambient air 179 is then mixed with the exhaust gases 162 from the turbine 142 to dissipate the heat contained therein. The dissipation of the heat in the exhaust gases 162 makes the power plant 100 and the projectile 140 less vulnerable to detection by infrared type sensor devices. The ambient air and exhaust gas mixture is then fed to the ducted fan type propeller 172 as shown in FIGS. 3 and 5 or to the unducted fan type propeller 173 shown in FIG. 4 to provide the thrust to propel the projectile 140.

The ducted fan type propeller 172 is internally located within the metal housing or outer tube 160 as shown in FIGS. 3 and 5. The ducted fan type propeller 172 serves to provide the thrust to the projectile 140 by compressing (e.g., speeding up) the air as the air passes through the outer tube 160. Since the ducted fan type propeller 172 is located inside of the outer tube 160, it is usually of a small size. A plurality of fan blades 180 of the ducted fan type propeller 172 are shown in FIGS. 3 and 5. The fan blades 180 are shown mounted to a center cog 182 having a center penetration 184 (shown best in FIG. 3) for accommodating the output drive shaft 176. The fan blades 180 serve to compress the air mixture. The number of fan blades 180 and the RPM at which they rotate provide a certain level of thrust to the projectile 140. The RPM of the fan blades 180 is directly related to the output of the turbine 142 and the speed reduction gearbox 174, if used.

The unducted fan type propeller 173 is positioned external to the projectile 140 as shown in FIG. 4 and serves the identical function as the ducted fan type propeller 172 shown in FIGS. 3 and 5. Since the unducted fan type propeller 173 is externally located, it can be much larger than the ducted fan type propeller 172. Therefore, the unducted fan type propeller 173 can produce a greater thrust for the same amount of energy expended by the combustion of the liquid fuel. For example, a twenty pound, 6" diameter projectile fitted with an unducted fan type propeller 173 will produce more thrust and travel further than the same projectile fitted with the ducted fan type propeller 172. A plurality of fan blades 181 are shown mounted to a center cog 183 having a penetration 177 for accommodating the output drive shaft 176. The fan blades 181 also serve to compress the air mixture. The number of fan blades 181 and the RPM at which they rotate provide a certain level of thrust to the projectile 140. The RPM of the fan blades 181 is also directly related to the output of the turbine 142 and the speed reduction gearbox 174, if used.

A symbolic connection (indicated by numeral 185) between the turbocharger 118 and the turbine axis 144 is shown in FIGS. 3 and 4. However, a physical connection between the turbocharger 118 and the turbine axis 144 is clearly shown in FIGS. 5 and 6. The physical connection between these two elements indicates that the turbocharger 118 is rotatively driven by the turbine axis 144 during normal operation. The physical connection can be by direct drive or through a gear train or by any acceptable means known in the art. The self-driven design disclosed in FIGS. 3–6 provides convenient portability to the power plant 100.

Figure 6:
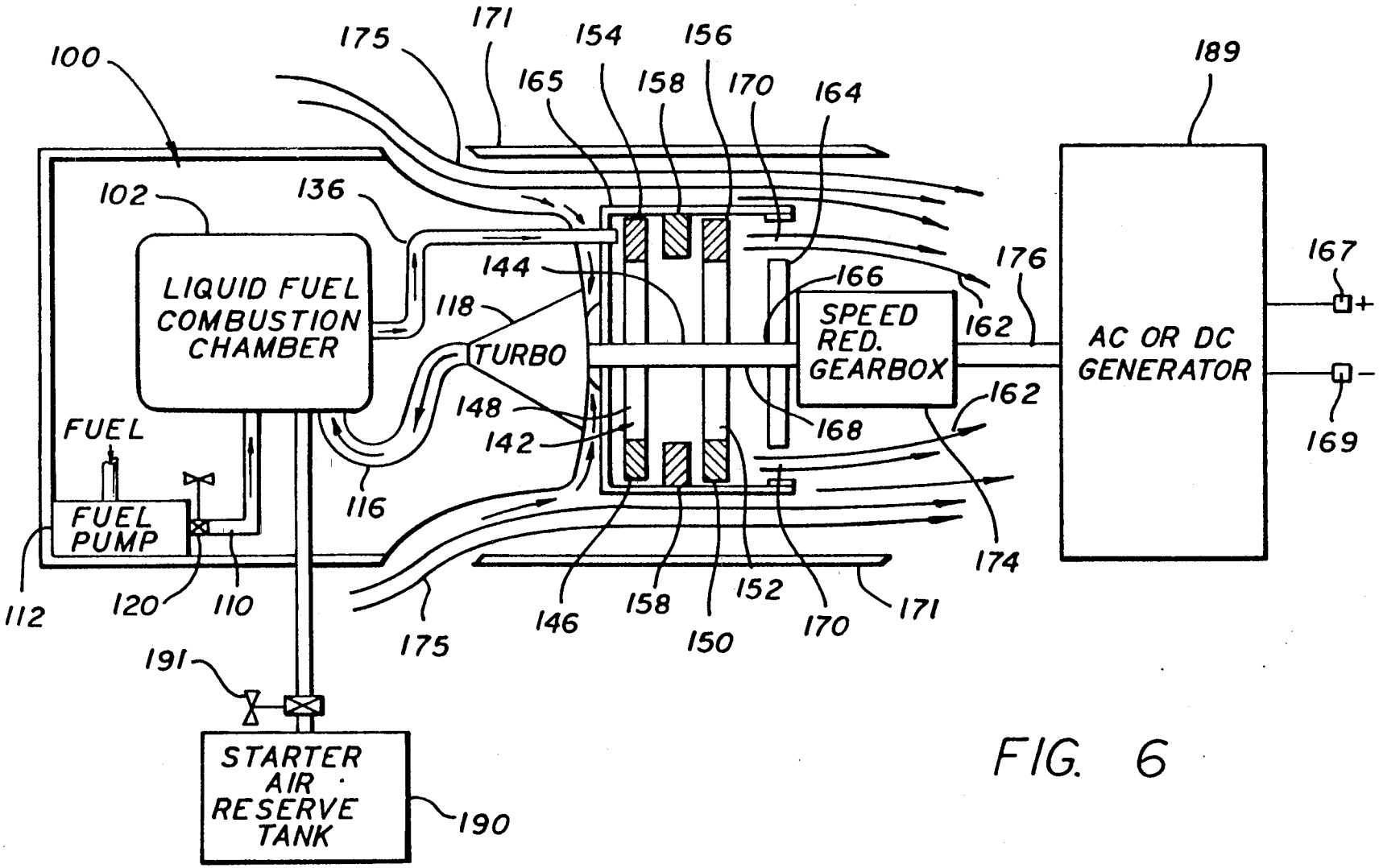
FIG. 6 is a more detailed view, partly in section and partly in block, of an application of the liquid fuel power plant of FIG. 1 showing the power plant connected to a generator load.

A set of ducts 175 located in the outer tube 160 shown in FIG. 5 and in the outer housing 171 shown in FIG. 6 permits ambient air to be drawn into the turbocharger 118. The turbocharger 118 compresses a large volume of the ambient air and delivers a high volume of compressed preheated air to the combustion chamber 102 via the air inlet line 116. The turbocharger 118 can be, for example, an impeller type device which is known in the art. In general, the speed of the turbocharger 118 is controlled by the volume of the fuel input to the combustion chamber 102. The more fuel that is delivered to and consumed by the combustion chamber, the greater the volume of hot expanding gases comprise the exhaust gases. The higher the volume and pressure of the exhaust gases, the faster the turbine 142 and the turbocharger 118 are rotated.

During the initial operation of the power plant 100, the turbine axis 144 is stationary and thus the turbocharger 118 is not rotated and does not provide the compressed air input to the combustion chamber 102. Therefore, a starter motor 186 as shown in FIG. 5 can be provided to rotate the turbine shaft 142 during each initial operation. The starter motor 186 can be energized by a battery 187 and controlled in any suitable manner. A starter switch 188 is shown for illustration purposes only. The starter motor 186 is designed to rotate the turbine axis 144 between ten-thousand and twenty-thousand RPM. This speed is sufficient to operate the turbocharger 118 to provide the initial compressed air input to the combustion chamber 102. After the exhaust gases are developed and the turbine 142 is rotating at speed, the turbocharger 118 is rotated by the turbine axis 144 as previously described. A battery charging mechanism (not shown) is provided to recharge the battery 187 during nonuse periods.

Other examples of the utility of the present invention exist which include the liquid fuel power plant 100. The power plant 100 interfaces with the turbine 142, the turbocharger 118 and the drive shaft 168 as described above. However, the ducted fan type propeller 172 and the unducted fan type propeller 173 are replaced by another load. A suitable load can be, for example, a DC or an AC electrical generator 189 as shown in FIG. 6. The generator 189, which is known in the art, is caused to rotate by the output drive shaft 176. The electrical output of the generator 189 is used to provide power to other electrical loads via a pair of output terminals 167 and 169. The generator 189 is shown positioned external to the outer housing 171 but could be designed to be located internal to the outer housing 171. The generator 189 is portable and can be utilized for stationary applications (e.g., non-projectile applications). Thus, the gases exhausted from the passageway 170 formed within the diffuser plate 164 are mixed with the ambient air drawn into the outer housing 171 via the ducts 175 to cool the generator 189. Further, a supercharger can be used in place of the turbocharger 118 for stationary applications. A supercharger is a known device employing lobed cams utilized for compressing air that is delivered to the combustion chamber 102.

An alternative method to the starter motor 186 shown in FIG. 5 for initiating operation of the combustion chamber 102 is disclosed in FIG. 6. Since the turbine axis 144 is initially stationary, the turbocharger (or supercharger) 118 is not rotated. Thus the turbocharger (or supercharger) 118 does not initially provide compressed air to the combustion chamber 102. In order to initiate combustion in the chamber 102, a starter air reserve tank 190 known in the art can be provided. The starter air reserve tank 190 contains compressed air that temporary replaces the turbocharger (or supercharger) 118 and has sufficient volume and air pressure to initiate combustion in the chamber 102. Thereafter, the generation of the hot pressurized gases within the combustion chamber 102 cause the turbine axis 144 to rotate at speed. The release of the pressurized air from the air reserve tank 190 can be controlled by, for example, an electrical solenoid control valve 191 as shown in FIG. 6. After normal operation of the power plant 100 is achieved, the solenoid control valve 191 is closed. The air reserve tank 190 can then be recharged by a compressor device (not shown) for subsequent use. The remainder of the structure shown in FIG. 6 and the operation thereof is duplicate to that previously described with reference to FIGS. 3–5.

Figure 7:
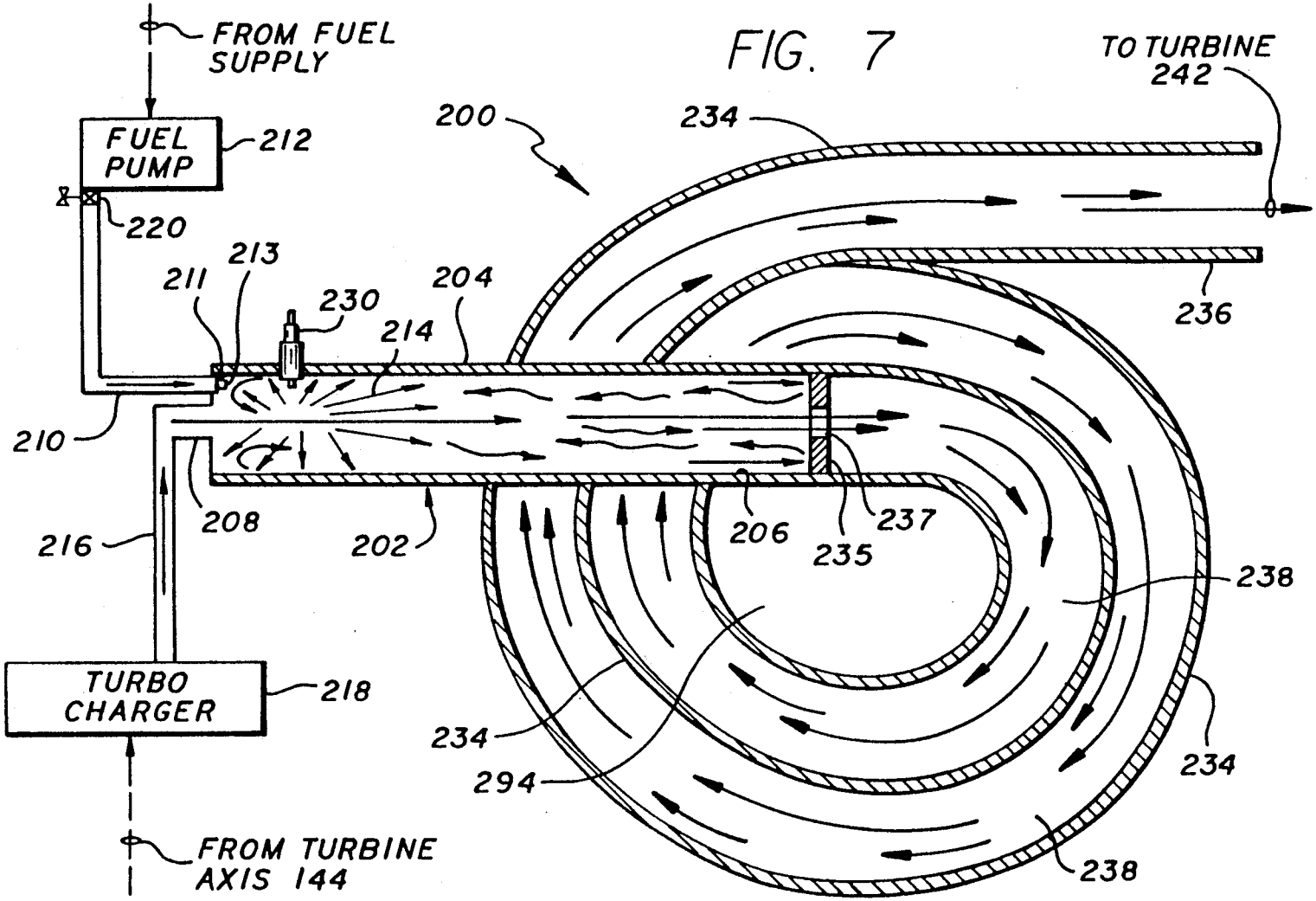
FIG. 7 is a simplified front elevational view of an alternative embodiment of the liquid fuel power plant of the present invention showing a turbo-charger and a combustion chamber extension having a modified spiral configuration.

A simplified alternative embodiment of the liquid fuel power plant of the present invention is shown in FIG. 7. In this instance, the alternative embodiment of FIG. 7 incorporates a spiral-shaped combustion chamber and extension similar to the corresponding components of the power plant 100 of the preferred embodiment shown in FIGS. 1 and 2. Components of the liquid fuel power plant of FIG. 7 which find substantial correspondence in structure and function to those components of FIGS. 1 and 2 are designated with corresponding reference numerals of the two-hundred series.

The liquid fuel power plant 200 shown in FIG. 7 includes an open-ended combustion chamber 202 comprising an ignition region 214 and a reaction region 238. The construction of the combustion chamber 202 includes an outer wall 204 and an inner wall 206 similar to that described in FIG. 1. A port 208 is formed to receive the compressed air from a compressed air inlet line 216 and a turbocharger 218. A combustible fuel can also be fed through the port 208 in a manner similar to that described in FIG. 1. In the alternative, a separate fuel feed line 210 can be connected directly to the ignition region 214 of the combustion chamber 202 as shown in FIG. 7. A fuel pump 212 is employed to force the combustible fuel through the fuel feed line 210 and through a fine spray nozzle 211 formed by forming a hole 213 in the end of the fuel feed line 210 for atomizing the fuel delivered to the ignition region 214. A gate control valve 220 located in the fuel feed line 210 is provided to prevent backfeeding of the fuel into line 210. Since the input pressure to the combustion chamber 202 (i.e., from the turbocharger 218) is greater than the exhaust pressure, a gate control valve is not required in the air inlet line 216. The compressed air and the combustible fuel are mixed in the ignition region 214 to form an air-fuel mixture.

A heat shield and an air passageway (neither shown in FIG. 7) are provided in the same manner as shown and described in FIG. 1. The heat shield (shown in FIG. 1) conserves the heat generated by the combustion chamber 202 to increase the efficiency of the power plant 200. The air passageway (shown in FIG. 1) permits the input air from the air input line 216 to pass between the heat shield (shown in FIG. 1) and the outer wall 204 to preheat the input air. This action also serves to improve the efficiency of combustion within the chamber 202. An igniter 230 passes through an opening in the heat shield (shown in FIG. 1) to penetrate the combustion chamber 202. The igniter 230 can be a spark plug or a glow wire depending upon the combustible fuel selected for use.

The combustion chamber includes a spiral-shaped extension 234 which serves to provide the reaction region 238 as shown in FIG. 7. Located within the spiral-shaped extension 234 is an air-flow turbulator 235 also shown in FIG. 7. The turbulator 235, which includes a center penetration 237 therethrough, is positioned across the width of the spiral-shaped extension 234. The turbulator 235 serves to generate turbulence in the hot pressurized gases in the same manner as that described with reference to FIGS. 1 and 2. The hot pressurized gases not passing through the center penetration 237 of the turbulator 235 are temporarily delayed from exiting the ignition region 214. The delayed gases are forced to recirculate back to the ignition region 214 to again be exposed to the combustion. The distance between the spray nozzle 211 in the ignition region 214 and the turbulator 235 must be a straight line as is shown in FIG. 7 to ensure proper recirculation and complete combustion of the gases. The end of the spiral-shaped extension 234 becomes an exhaust tube 236.

It is beneficial to build the combustion chamber 202 in a manner to feed the air-fuel mixture to the center of the power plant 200 and to have the extension 234 spiral outward as shown in FIG. 7 instead of an extension that spirals inward to the center of the power plant as shown in FIGS. 1 and 2. Several advantages to building an outward spiraling extension 234 of the combustion chamber 202 exist. One advantage is that an outward spiraling extension 234 enables generating higher exhaust gas pressure via centrifugal force as compared to a inward spiraling extension. Further, the input (e.g., exhaust gases) to a turbine from the outward spiraling extension 234 must be directed from the top of the combustion chamber 202. Therefore, an outward spiraling extension 234 conveniently positions the exhaust tube 236 at the input of a turbine manifold (not shown). This design permits the exhaust tube 236 to be shorter. Additionally, the outward spiraling extension 234 can be built to assume a toroidal shape. This design permits passing the drive shaft 276 shown in FIG. 8 through the toroidal penetration to conveniently operate a load located downstream of the power plant 200. Also, the center of the combustion chamber remains cooler when the extension 234 is built as an outward spiral. Thus, the drive shaft is not exposed to the intense heat of the combustion chamber 202.

In operation, the power plant 200 shown in FIG. 7 functions in a manner duplicate to that described for the power plant 100 shown in FIGS. 1 and 2. The air-gas mixture is initially ignited in the ignition region 214 of the combustion chamber 202. The ignited mixture is forced by the compressed air to pass through the outward spiraling extension 234. The turbulator 235 interferes with the flow of the hot pressurized gases and recirculates a portion of the gas back to the ignition region 214 to increase the efficiency of combustion. The heat from the combustion causes the extension 234 to become sufficiently hot to ensure the total combustion or decomposition of the air-fuel mixture. The exhaust gases are pollution free and exhibit a low-to-medium temperature and a maximum pressure of approximately 100 PSI. The exhaust tube 236 directs the hot pressurized expanding gases to a load such as a turbine 242 shown in FIG. 8. The use of the exhaust gases by the turbine 242 to perform useful work is the same as that described with reference to FIGS. 3–6.

Figure 8:
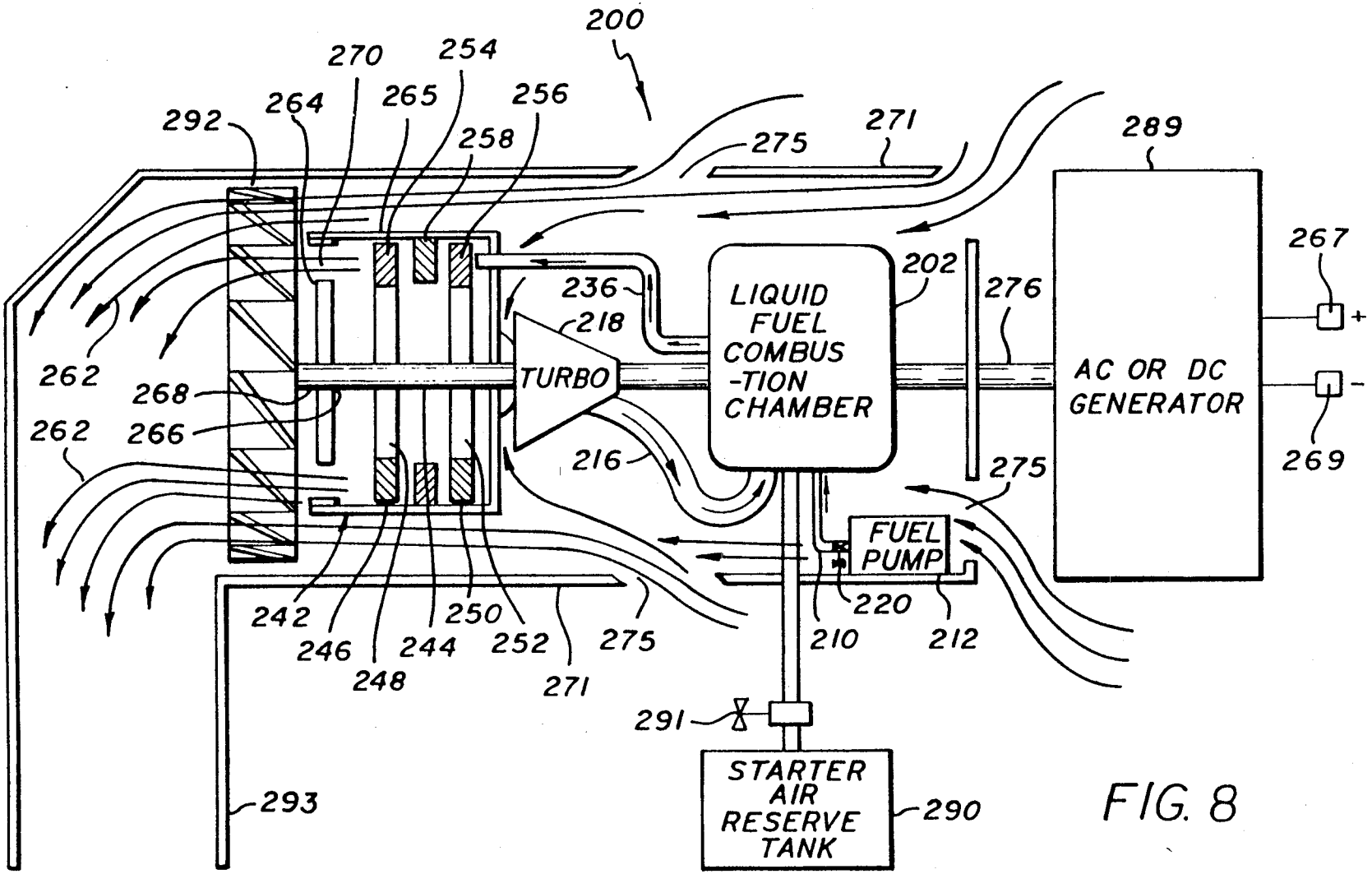
FIG. 8 is an elevational view, partly in section and partly in block, of an application of the liquid fuel power plant of FIG. 7 showing the power plant connected to a generator load.

An application of the liquid fuel power plant 200 is shown in FIG. 8. The power plant 200 shown in FIG. 8 is located within an outer housing 271 and is utilized to rotate the turbine 242 at high RPM. An exhaust tube 236 is connected between the end of the combustion chamber extension 234 (shown in FIG. 7) and the turbine 242. The hot pressurized gases generated by the combustion chamber 202 are directed through the exhaust tube 236 to spin the turbine 242 about a turbine axis 244 in a similar manner as described with reference to FIGS. 3–6. The use of the power plant 200 as shown in FIG. 8 permits reorganizing the major components of the power plant 100 shown in FIGS. 3–6.

The liquid fuel power plant 200 comprising the combustion chamber 202 and the combustion chamber extension 234 as described and shown in FIG. 7 is positioned between the turbine 242 and the load, e.g., generator 289, as shown in FIG. 8. The exhaust tube 236 delivers the hot pressurized gases from the combustion chamber extension 234 to the turbine 242. The exhaust gases 262 from the turbine 242 are discharged from the passageway 270 formed in the diffuser plate 264. The exhaust gases combine with ambient air entering the outer housing 271 via the ducts 275. The turbine 242 directly drives the output shaft 276. A speed reduction gearbox is not utilized in this example. The output shaft 276 drives a ducted fan 292 located at one end of the turbine 242. The ducted fan 292 pulls the mixture of the exhaust gases and the ambient air out of the outer housing 271 to atmosphere via an exhaust duct 293. Use of the ducted fan 292 provides the advantage of dragging cooler ambient air past the load for cooling the generator 289.

The drive shaft 276 also rotates the turbocharger 218 and the generator 289 each located at the opposite end of the turbine 242 from the ducted fan 292. The rotating turbocharger 218 provides the pressurized air input to the combustion chamber 202 via the air inlet line 216 as described with respect to FIGS. 3–6. The construction of the combustion chamber extension 234 as illustrated in FIG. 7 permits the passage of the output drive shaft 276 through a toroid 294 formed by the extension 234. The rotating output drive shaft 276 then rotates the generator 289 to generate and distribute electrical power to other loads (not shown) via output terminals 267 and 269. A starter air reserve tank 290 and an electrical solenoid control valve 291 can be provided as shown in FIG. 8 to initiate combustion in the chamber 202. The operation of the air reserve tank 290 and the control valve 291 is the same as that described with reference to FIG. 6. In the alternative, a starter motor as shown in FIG. 5 could also be fitted to the power plant 200 shown in FIG. 8.

Thus, the present invention has been described herein with reference to a particular embodiment for a particular application. Those having ordinary skill in the art and access to the present teachings will recognize additional modifications, applications and embodiments within the scope thereof. Although the detailed description is directed to a turbine driven air vehicle application, the liquid fuel power plant of the present invention is equally applicable to driving other loads.

It is therefore intended by the appended claims to cover any and all such modifications, applications and embodiments within the scope of the present invention.

Accordingly,

What is claimed is:

1. A liquid fuel power plant comprising:

a combustion chamber having an ignition region for receiving combustible liquid fuel and an oxidizer, and having means for igniting said fuel in said ignition region, the combustible fuel being ignited in said ignition region to produce hot pressurized gases in said combustion chamber;

an extension combustion chamber having a first end and a second end, said extension combustion chamber being coupled at the first end to the combustion chamber to receive said hot pressurized gases from said combustion chamber, said extension combustion chamber providing a reaction region for further combustion of said hot pressurized gases received from said combustion chamber, said further combusted hot pressurized gases being exhausted at the second end of said extension combustion chamber, said extension combustion chamber being a spiral-shaped chamber having an inner wall and an outer wall and being formed by one of said walls being wrapped on itself to provide a plurality of spirals, whereby said spiral-shaped chamber has an outside end and an inside end; and means for delivering said combustible liquid fuel to said ignition region; and charging means for delivering compressed air as said oxidizer to said ignition region.

2. A liquid fuel power plan as recited in claim 1 further comprising means for generating turbulence in the hot pressurized gases in the combustion chamber, said means for generating turbulence being disposed between said combustion chamber and said extension combustion chamber.

3. A liquid fuel power plant as recited in claim 2 wherein said means for generating turbulence comprises an disk disposed across the first end of said extension combustion chamber, said disk having a center penetration allowing passage of hot gases from the combustion chamber into said extension combustion chamber.

4. A liquid fuel power plant as recited in claim 2 further including a turbine for converting said pressurized gas to rotary motion;

a drive shaft rotated by said turbine for transferring said rotary motion; and a diffuser plate surrounding said drive shaft and having a passageway formed therethrough for directing said pressurized gas away from said turbine; and said charging means is a turbo charger coupled to be rotated by said drive shaft.

5. A liquid fuel power plant as recited in claim 2 further including a turbine for converting said pressurized gas to rotary motion;

a drive shaft rotated by said turbine for transferring said rotary motion; and a diffuser plate surrounding said drive shaft and having a passageway formed therethrough for directing said pressurized gas away from said turbine; and said charging means is a super charger coupled to be rotated by said drive shaft.

6. A liquid fuel power plant as recited in claim 3 further comprising heat shield means disposed for retaining heat in said combustion chamber and said extension combustion chamber.

7. A liquid fuel power plant as recited in claim 6 wherein said heat shield means is disposed away from said combustion chamber and said extension combustion chamber to provide a passage way for heating pressurized air from said charging means.

8. A liquid fuel power plan as recited in claim 1 wherein said spiral-shaped extension combustion chamber is a spiral-shaped chamber having an inner wall and an outer wall and is formed by the outer wall being wrapped inward on itself to provide a plurality of inward spirals, said second end of the spiral-shaped chamber being said inside end and being disposed at the center of the spiral-shaped chamber.

9. A liquid fuel power plan as recited in claim 1 wherein said spiral-shaped extension combustion chamber is a spiral-shaped chamber having an inner wall and an outer wall and is formed by the inner wall being wrapped outwardly on itself to provide a plurality of outward spirals, said second end of the spiral-shaped chamber being the outside end of the spiral-shaped chamber.

* * * * *